US005101866A

United States Patent [19]

Quigley

[11] Patent Number: 5,101,866

[45] Date of Patent: Apr. 7, 1992

[54] DOUBLE LAYER PAPERMAKERS FABRIC HAVING EXTRA SUPPORT YARNS

[75] Inventor: Scott D. Quigley, Tallahassee, Fla.

[73] Assignee: Niagara Lockport Industries Inc., Quincy, Fla.

[21] Appl. No.: 641,189

[22] Filed: Jan. 15, 1991

[51] Int. Cl.[5] ..... D03D 13/00

[52] U.S. Cl. ..... 139/383 A; 139/413

[58] Field of Search ..... 139/383 A, 413, 414

[56] References Cited

U.S. PATENT DOCUMENTS

| | | | |
|---|---|---|---|
| 4,815,503 | 3/1989 | Borel | 139/383 A |
| 4,909,284 | 3/1990 | Kositzke | 139/383 A |
| 4,934,414 | 6/1990 | Borel | 139/383 A |
| 4,982,766 | 1/1991 | Taipale et al. | 139/383 A |
| 4,987,929 | 1/1991 | Wilson | 139/383 A |
| 5,025,839 | 6/1991 | Wright | 139/383 A |

*Primary Examiner*—Andrew M. Falik

*Attorney, Agent, or Firm*—Lorusso & Loud

[57] ABSTRACT

A double layer papermaking fabric includes a plurality of machine direction yarns interwoven with a plurality of layers of cross direction yarns including an upper, paper side layer of yarn comprising a first set of generally parallel main cross direction yarns having one of a plurality of extra support yarns interposed between each adjacent yarn of this first set of main cross direction yarns and a plurality of machine direction yarns with each machine direction yarn interweaving with only a single yarn of the first set of main cross direction yarns in each weave repeat of the machine direction yarn. The double layer fabric also includes a lower, machine side layer of yarns including a second set of generally parallel main cross direction yarns with the machine direction yarns interweaving with at least one yarn of that second set of main cross direction yarns in each weave repeat of the machine direction yarns.

10 Claims, 6 Drawing Sheets

DOUBLE LAYER PAPERMAKERS FABRIC HAVING EXTRA SUPPORT YARNS

FIELD OF THE INVENTION

This invention relates to papermaking fabrics and more specifically to such papermaking fabrics having a double layer weave with extra support or stuffer weft yarns interposed between each cross machine direction weft yarn on the papermaking side of the fabric.

BACKGROUND OF THE INVENTION

In papermaking operations a number of endless belts woven of synthetic yarns and filaments are used, including the initial forming fabrics, wet press felts and dryer felts. To obtain desirable results in the papermaking process several different characteristics of various weaves are sought. These characteristics include air permeability to assist in removing water from the papermaking slurry or furnish, dimensional stability, long wear and, for finer grades of paper, a relatively smooth supporting surface on the papermaking side of each fabric. In these papermaking fabrics, particularly with respect to the forming fabrics, a smooth upper or paper supporting surface is desirable to provide a smooth surface on the paper mat being formed. This characteristic can be obtained by providing a dense and tightly woven paper supporting surface, but such a tightly woven surface reduces the air permeability and thus water removal, requiring a slower running speed on the papermaking apparatus in order to remove the necessary amount of water. Looser and more open weaves can provide a more rapid removal of water, but provide less support and thus a rougher marking of the paper surface than the close weave.

It has been found that some of these desirable characteristics of greater support provided by a tighter weave may also be provided to a looser, more open weave, by the provision of additional, or extra support yarns extending in the cross machine direction and interwoven with the machine direction yarns. These extra support yarns may conveniently be provided in the form of an extra yarn interposed between each pair of the main cross directional yarns.

Use of such extra support yarns has been disclosed in prior patents, such as Kositzke, U.S. Pat. No. 4,909,284, which provides for such extra support yarn in a papermaking fabric. However, in Kositzke, as well as in other known papermaking fabric weaves utilizing extra support yarns, the full benefit of those extra support yarns may not be realized because of the multiple warp float extending over two or more of the cross machine direction yarns in each weave repeat. Such double or triple warp floats pull those cross machine direction yarns below the papermaking surface of the fabric and reduce the maximum length possible for support given by the cross direction yarns in each weave repeat. This inherently provides a rougher papermaking surface for the fabric and, thus, a less smooth paper manufactured thereby.

SUMMARY OF THE INVENTION

It is an object of the present invention to provide a double layer papermaking fabric for use on a papermaking machine. The fabric of this invention includes a plurality of machine direction yarns interwoven with a plurality of layers of cross machine direction yarns in which that fabric includes an upper, paper side layer of yarns and a lower, machine side layer of yarns. The paper side layer of yarns includes a first set of generally parallel main cross direction yarns having one of a plurality of extra support yarns interposed between each adjacent yarn of the first set of main cross direction yarns and extending generally parallel thereto, and a plurality of machine direction yarns, with each such machine direction yarn interweaving with only a single yarn of the first set of main cross direction yarns in each weave repeat of the machine direction yarn. The lower, machine side layer of yarns comprises a second set of generally parallel main cross direction yarns with the machine direction yarns interweaving with at least one yarn of that second set of main cross direction yarns in each weave repeat of the machine direction yarns.

BRIEF DESCRIPTION OF THE DRAWINGS

Preferred embodiments of this invention will be described in detail below in connection with the attached drawings in which.

Figure 4:
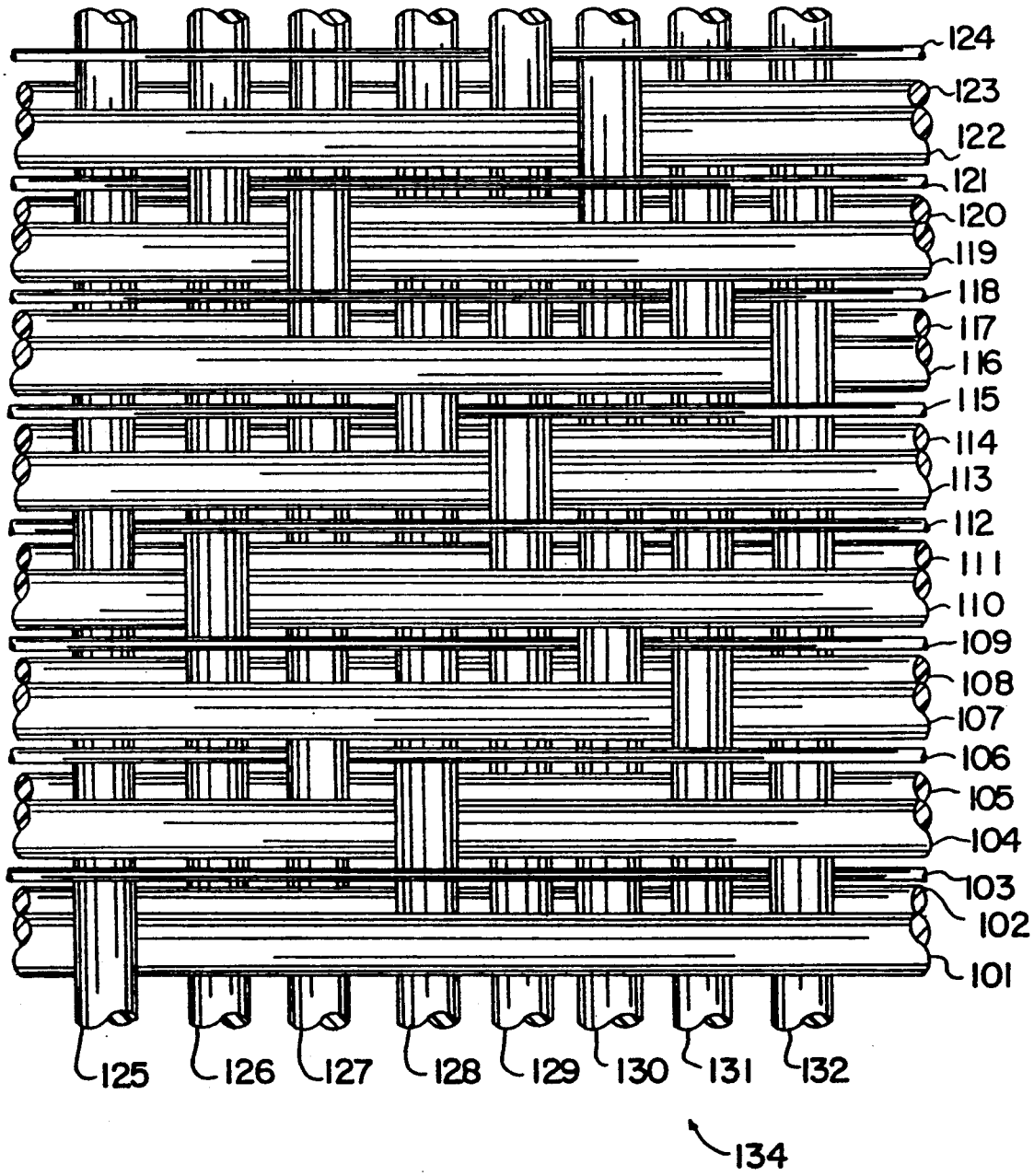
Figure 5:
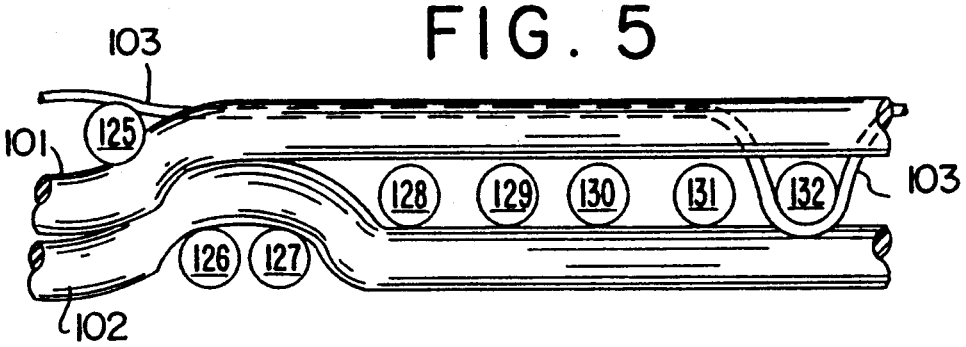

FIGS. *3a–3g* are side sectional views taken facing the respective machine direction yarns 22, 23, 24, 25, 26, 27 and 28, respectively;

FIG. 4 is a fragmentary top plan view of the weave of this invention embodied in an eight harness weave;

FIG. 5 is an end view of the fabric of FIG. 4 looking in the machine direction at cross machine direction yarn 101; and FIGS. *6a–6h* are sectional views of the fabric of FIG. 4, taken facing the respective machine direction yarns 125, 126, 127, 128, 129, 130, 131 and 132, respectively.

DETAILED DISCUSSION OF PREFERRED EMBODIMENTS

Figure 1:
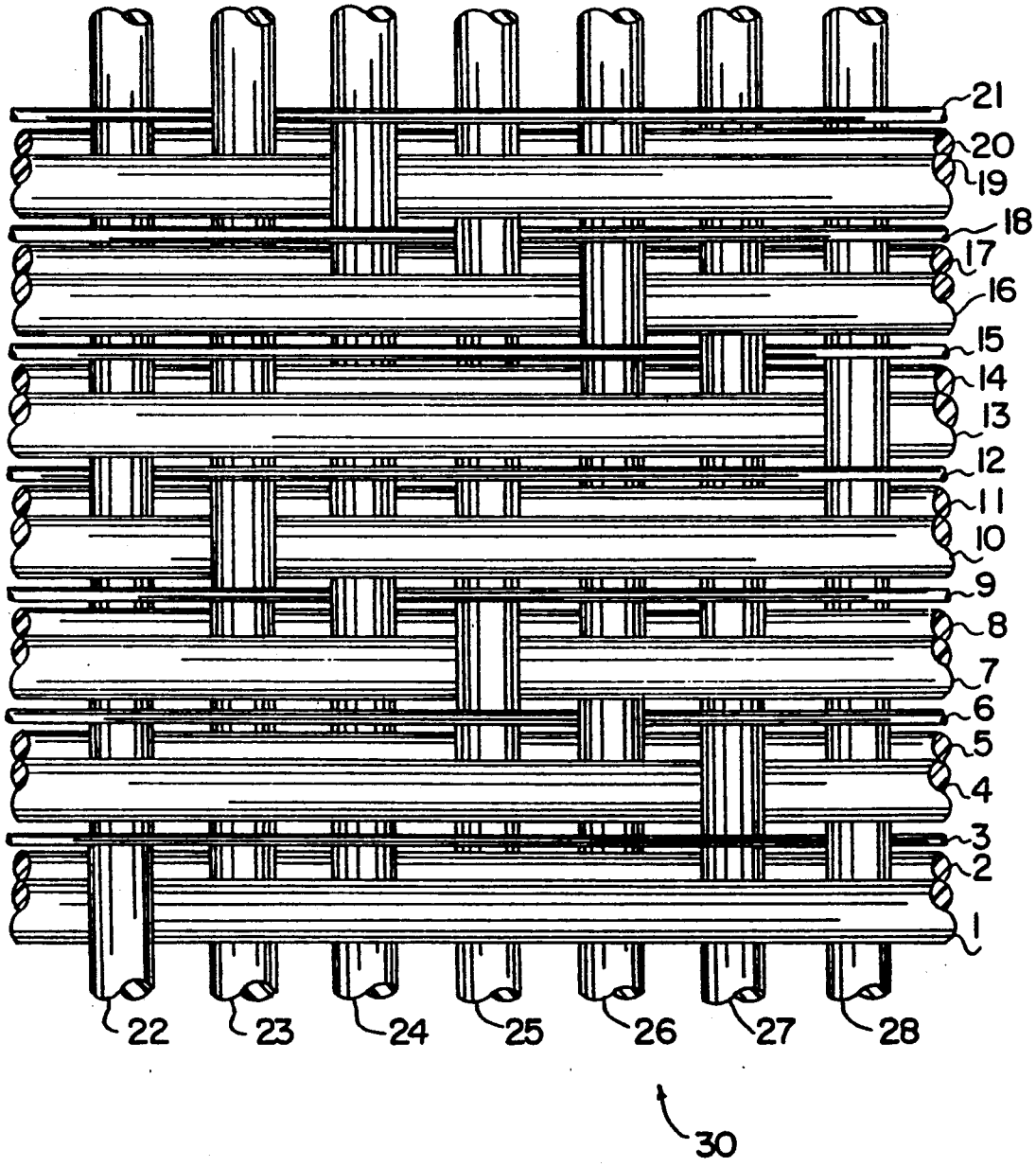
FIG. 1 is a top plan view of a segment of the paper side of the fabric weave of this invention in the form of a seven harness weave and illustrated at a greatly enlarged scale.
Figure 2:
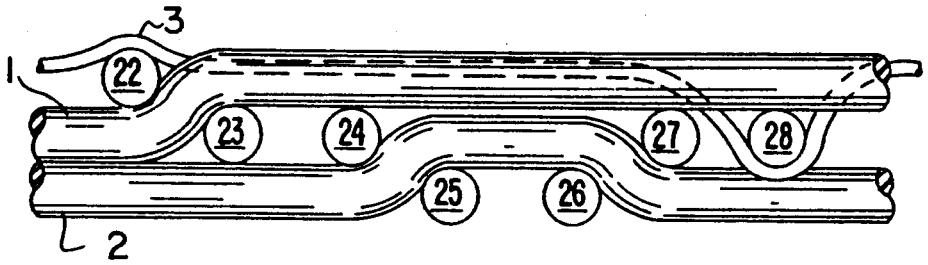
FIG. 2 is an end view looking in the machine direction at yarn 1 of the weave of FIG. 1.

Two particularly preferred embodiments of the papermaking fabric of the present invention are illustrated in the figures, with FIGS. 1–3 being of a seven harness embodiment and FIGS. 4–6 illustrating an eight harness embodiment. It is, of course, to be understood that this invention is not limited to either seven harness or eight harness weaving but may be incorporated with any number of different weaves to provide similar results and benefits.

While the illustrations are drawn schematically at greatly increased scale for purposes of clarity of explanation, the primary features of the invention are illustrated in those figures. It is understood, of course, that the illustrated fragment of the fabric is but a typical section of the overall fabric. The fabric 30 is, as best shown on FIGS. 2 and *3a–3g*, a double layer or duplex weave having an upper, paper side layer of yarns and a lower, machine side layer of yarns interwoven with a plurality of machine direction yarns. The upper, paper side layer of yarns includes a first set of generally parallel main cross direction yarns, 1, 4, 7, 10, 13, 16 and 19 with a set of extra support yarns 3, 6, 9, 12, 15, 18 and 21 interposed between adjacent yarns of that first set of main cross direction yarns. The lower or machine side layer of the yarns comprises a second set of generally parallel main cross direction yarns 2, 5, 8, 11, 14, 17 and 20, which, preferably, may be stacked generally below the corresponding yarns of the first set of main cross direction yarns. The machine direction yarns interweaving with those cross direction yarns include, in this embodiment, yarns 22, 23, 24, 25, 26, 27 and 28. The yarns of this weave, both in the machine direction and the cross machine direction may conventionally be formed of synthetic polymeric resin and may be either monofilament or multiple strand twisted yarn, well known to those skilled in the art. As illustrated in the figures, the provision of the two sets of generally parallel main cross direction yarns in a generally stacked formation illustrated in this embodiment will promote water removal for faster operation of the papermaking process, while providing additional durability found in double layer fabrics.

As shown on FIG. 1 and with greater clarity in FIGS. 3*a*–3*g*, the extra support yarns 3, 6, 9, 12, 15, 18 and 21 at least partially fill the space between each of the yarns of the first set of main cross direction yarns 1, 4, 7, 10, 13, 16 and 19 to provide extra support and reduced marking during the papermaking process. In prior art weaves utilizing the extra support weft yarns extending in the cross machine direction, there has generally been provided an interweave between the machine direction warp yarns and those extra support yarns of at least a double warp float, that is, a weave in which each interweave of the warp yarn with the extra support yarns floats over two or more of those cross direction yarns. As shown most clearly in FIGS. 2 and 3*a*–3*g* of the present invention, the weave of this invention eliminates that double warp float and allows the cross machine direction yarn to attain the maximum length possible for a given weave pattern repeat. This provides for better support by that papermaking fabric of the paper being made.

Figure 3A:
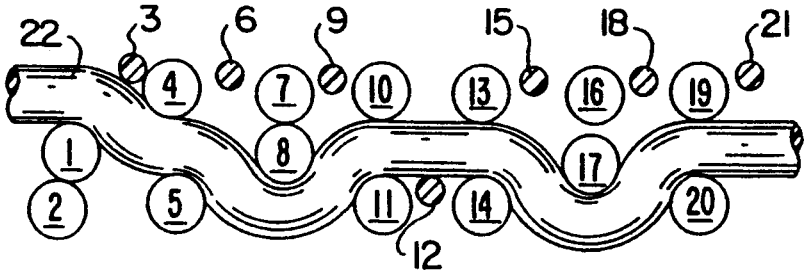
Figure 3B:
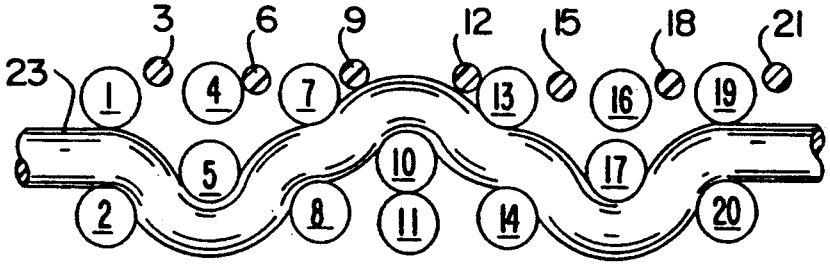
Figure 3C:
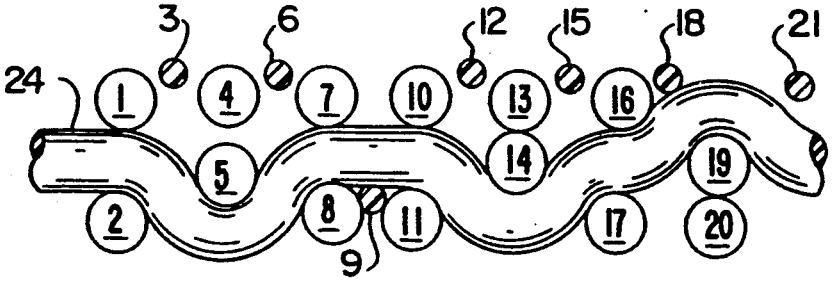
Figure 3D:
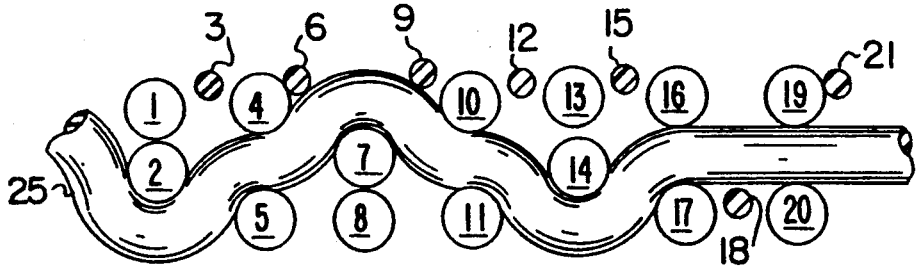
Figure 3E:
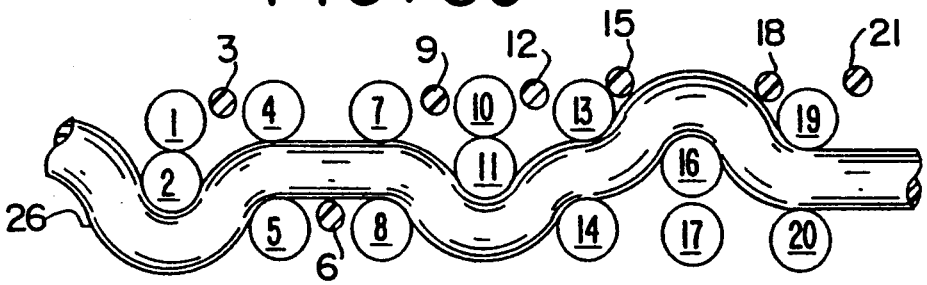
Figure 3F:
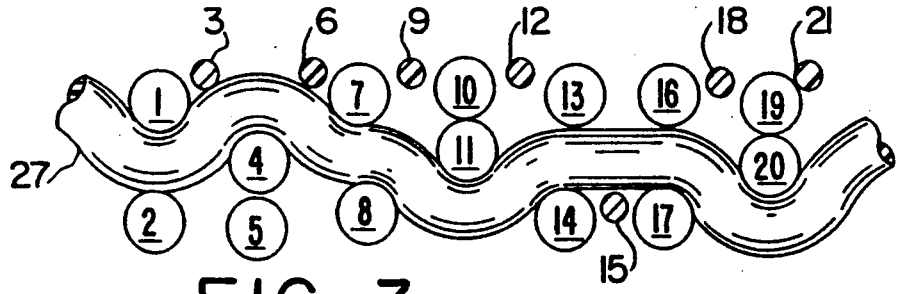
Figure 3G:
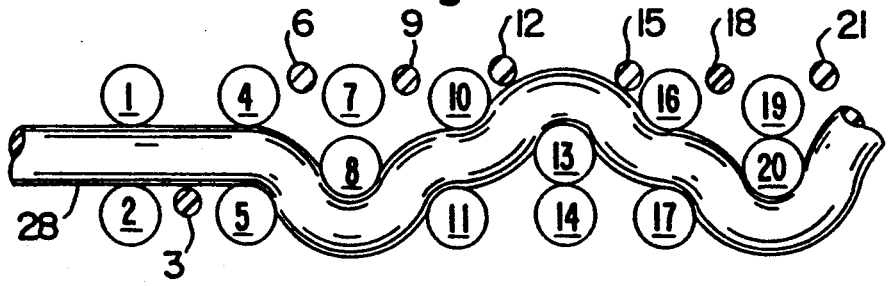

From the figures illustrating this preferred embodiment it should be noted that each of the machine direction yarns 22–28, interweaves with two yarns of the second or lower set of main cross direction yarns 1, 4, 7, 10, 13, 16 and 19 in each of the weave repeats of that machine direction yarn. Furthermore, in this preferred embodiment, each interweave of the machine direction yarns with that second or lower set of main cross direction yarns is spaced from any adjacent interweave, that is, passing beneath any other such yarn of the second set of main cross direction yarns by at least two other yarns of that second set of main cross direction yarns. In FIG. 3*a* this is illustrated by the interposition of the two yarns 11 and 14 of that second set of cross machine direction yarns interposed between the interweaves of the machine direction yarn 22 and the lower cross machine direction yarns 8 and 17. Similar arrangements prevail in the remainder of the illustrations. It should also be noted that each of the machine direction yarns 22–28 floats between the first set of main cross direction yarns 1, 4, 7, 13, 16 and 19 in this embodiment, and the second set of main cross direction yarns 2, 5, 8, 11, 14, 17 and 20 for a distance of at least two of those main cross direction yarns between the interweaves at least once in each machine direction weave repeat.

As shown most clearly in FIGS. 3*a*–3*g*, the cross machine direction extra support yarns 3, 6, 9, 12, 15, 18 and 21 interweave with the machine direction yarns 22–28 at points between adjacent interweaves of those machine direction yarns and the second or lower set of main cross direction yarns 2, 5, 8, 11, 17 and 20. Furthermore, each interweave between the machine direction yarns and the extra support cross direction yarns occurs only between the adjacent interweaves of the machine direction yarns and the second set of main cross direction yarns in which there is no interweave of the machine direction yarns with any yarn of the first, or upper, or paper side set of main cross direction yarns interposed therebetween. At least one yarn of the second set of main cross direction yarns 2, 5, 8, 11, 14, 17 and 20 is interposed between each interweave of the machine direction yarns with any of the extra support cross direction yarns and any interweave of the machine direction yarns and any yarn of the second set of main cross direction yarns. It may also be noted that each interweave of any of the machine direction yarns with any of the extra support yarns is spaced from any interweave of that machine direction yarn and any yarn of the first set of main cross direction yarn by at least three yarns of that first or paper side set of main cross direction yarns.

FIGS. 4–6 illustrate schematically an eight harness weave of a double layer or duplex weave generally similar in characteristics to the seven harness weave illustrated in FIGS. 1–3. This fabric 134 includes an upper, paper side layer of yarns and a lower, machine side layer of yarns interwoven with a plurality of machine direction yarns. The upper, paper side layer of yarns includes a first set of generally parallel main cross direction yarns, 101, 104, 107, 110, 113, 116, 119 and 122, with a set of extra support yarns 103, 106, 109, 112, 115, 118, 121 and 124 interposed between adjacent yarns of that first set of main cross direction yarns. The lower or machine side layer of the yarns comprises a second set of generally parallel main cross direction yarns 102, 105, 108, 111, 114, 117, 120 and 123, which, preferably, may be stacked generally below the corresponding yarns of the first set of main cross direction yarns. The machine direction yarns interweaving with those cross direction yarns include, in this eight-harness embodiment, yarns 125, 126, 127, 128, 129, 130, 131 and 132. The yarns of this weave, both in the machine direction and the cross machine direction may conventionally be formed of synthetic polymeric resin and may be either monofilament or multiple strand twisted yarn, well known to those skilled in the art. As illustrated in the figures, the provision of the two sets of generally parallel main cross direction yarns in a generally stacked formation illustrated in this embodiment will promote water removal for faster operation of the papermaking process, while providing additional durability found in double layer fabrics.

As shown on FIG. 4 and with greater clarity in FIGS. 6*a*–6*h*, the extra support yarns 103, 106, 109, 112, 115, 118, 121 and 124 at least partially fill the space between each of the yarns of the first set of main cross direction yarns 101, 104, 107, 110, 113, 116, 119 and 122 to provide extra support and reduced marking of the paper product during the papermaking process. As with the embodiment of FIGS. 1–3, the weave of FIGS. 4–6 eliminates the conventional double warp float of the warp yarns with the extra support yarns, which allows the cross machine direction yarns to attain the maximum length possible for a given weave pattern repeat.

Figure 6A:
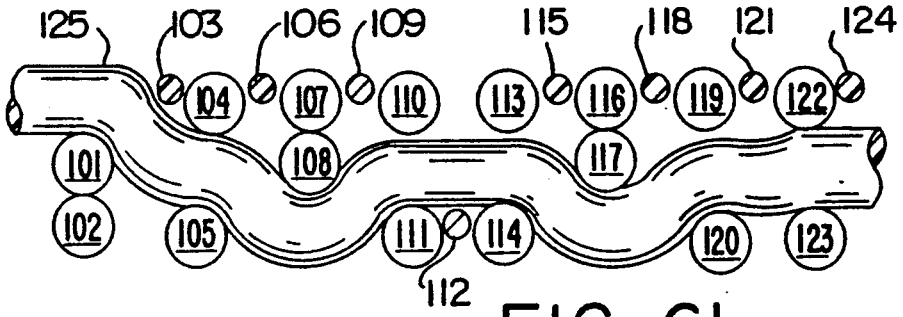
Figure 6B:
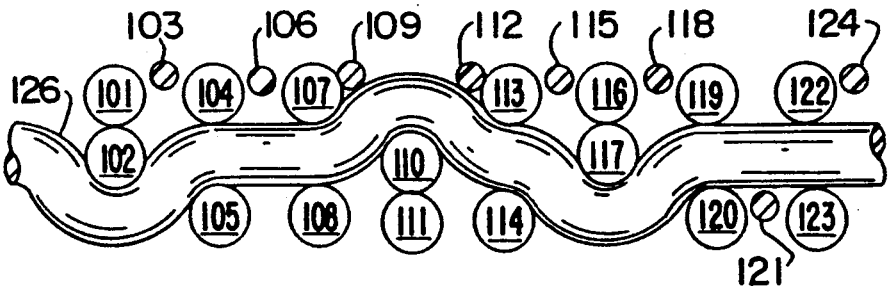
Figure 6C:
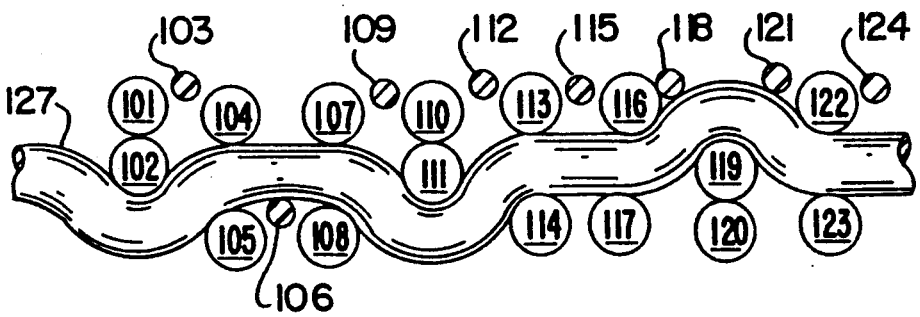
Figure 6D:
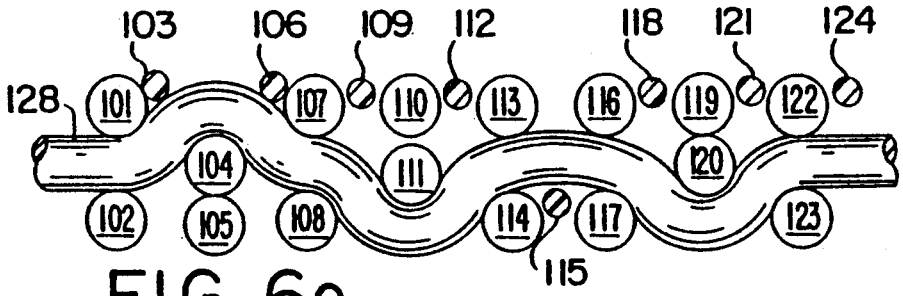
Figure 6E:
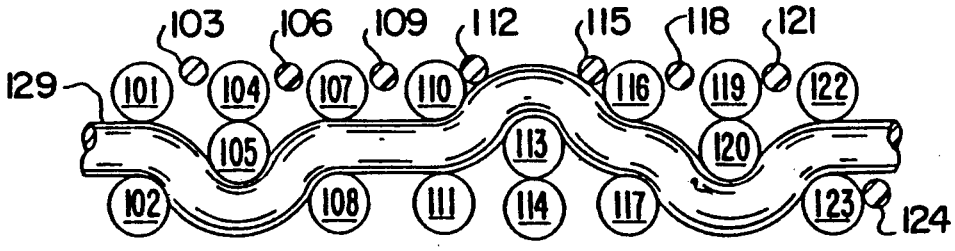
Figure 6F:
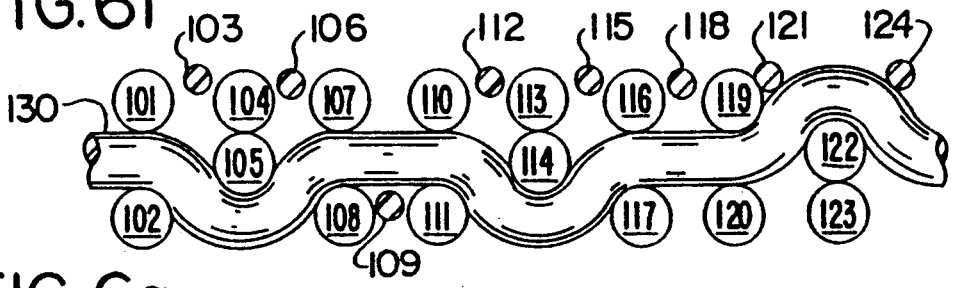
Figure 6G:
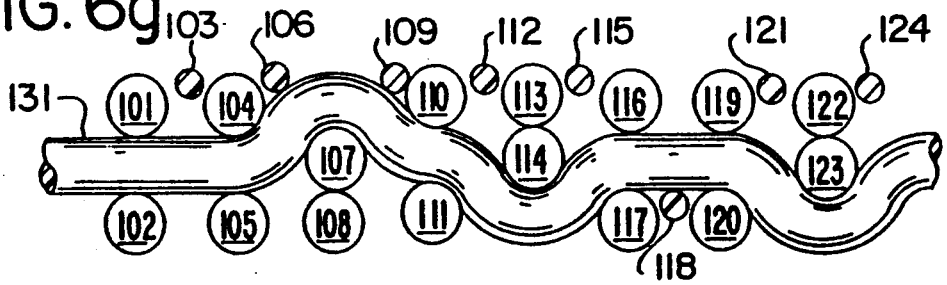
Figure 6H:
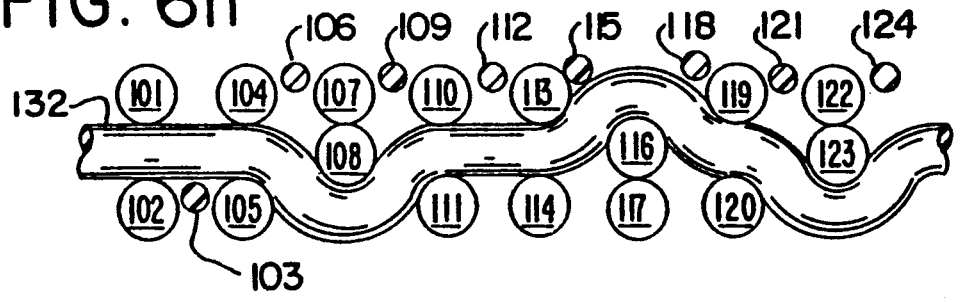

The drawings of this embodiment illustrate that each of the machine direction yarns 125–132 interweaves with two yarns of the second or lower set of main cross direction yarns 102, 105, 108, 111, 114, 117, 120 and 123 in each of the weave repeats of that machine direction yarn. Furthermore, in this eight-harness embodiment, each interweave of the machine direction yarns with that second or lower set of main cross direction yarns is spaced from any adjacent interweave, that is, passing beneath any other such yarn of the second set of main cross direction yarns, by at least two other yarns of that second set of main cross direction yarns. In FIG. 6a this is illustrated by the interposition of two yarns 111 and 114 of that second set of cross machine direction yarns interposed between the interweaves of the machine direction yarn 125 and the lower cross machine direction yarns 108 and 117. Similar arrangements prevail in the remainder of the illustrations. It should also be noted that each of the machine direction yarns 125–132 floats between the first set of main cross direction yarns 01, 104, 107, 113, 116, 119 and 122 in this embodiment, and the second set of main cross direction yarns 102, 105, 108, 111, 114, 17, 120 and 123 for a distance of at least two of those main cross direction yarns between interweaves at least once in each machine direction weave repeat.

With reference to FIGS. 6a–6h, the cross machine direction extra support yarns 103, 106, 109, 112, 115, 118, 121 and 124 interweave with the machine direction yarns 125–132 at points between adjacent interweaves of those machine direction yarns and the second or lower set of main cross direction yarns 102, 105, 08, 111, 114, 117, 120 and 123. Also, each interweave between the machine direction yarns and the extra support cross direction yarns occurs only between the adjacent interweaves of the machine direction yarns and the second set of main cross direction yarns in which there is no interweave of the machine direction yarns with any yarn of the first, or upper, or paper side set of main cross direction yarns interposed therebetween. At least one yarn of the second set of main cross direction yarns 102, 105, 108, 111, 114, 117, 120 and 123 is interposed between each interweave of the machine direction yarns with any of the extra support cross direction yarns and any interweave of the machine direction yarns and any yarn of the second set of main cross direction yarns, that is, where the machine direction yarn passes under such a yarn of the second set of main cross direction yarns. Each interweave of any of the machine direction yarns with any of the extra support yarns is spaced from any interweave of that machine direction yarn and any yarn of the first set of main cross direction yarns by at least three yarns of that first or paper side or upper layer of main cross direction yarns.

While the foregoing describes in detail two particularly preferred embodiments of the fabric of this invention, it is to be understood that these descriptions are illustrative only of the principles of the invention and are not to be considered limitative thereof. Thus, because numerous variations and modifications of the fabric of this invention will readily occur to those skilled in the art, the scope of this invention is to be limited solely by the claims appended hereto.

What is claimed is:

1. A double layer papermaking fabric for use on a papermaking machine and including a plurality of machine direction yarns interwoven with a plurality of layers of cross direction yarns, such fabric comprising an upper, paper side layer of yarns comprising a first set of generally parallel, main cross direction yarns having one of a plurality of extra support yarns interposed between each adjacent yarn of said first set of main cross direction yarns and extending generally parallel thereto, and a plurality of machine direction yarns with each said machine direction yarn interweaving with only a single yarn of said first set of main cross direction yarns in each weave repeat of said machine direction yarn, and a lower, machine side layer of yarns, comprising a second set of generally parallel main cross direction yarns, said machine direction yarns interweaving with at least one yarn of said second set of main cross direction yarns in each weave repeat of said machine direction yarns.

2. The papermaking fabric of claim 1 wherein each said machine direction yarn interweaves with two yarns of said second set of main cross direction yarns in each said weave repeat.

3. The papermaking fabric of claim 2 wherein each interweave of said machine direction yarns with said second set of main cross direction yarns is spaced from any adjacent said interweave with said yarns of said second set of main cross direction yarns by at least two other yarns of said second set of main cross direction yarns.

4. The papermaking fabric of claim 3 wherein each said machine direction yarn floats between said first set of main cross direction yarns and said second set of main cross direction yarns for a distance of at least two said main cross direction yarns between said interweaves at least once in each weave repeat.

5. The papermaking fabric of claim 1 wherein said cross direction extra support yarns interweave with said machine direction yarns at points between adjacent interweaves of said machine direction yarns and said second set of main cross direction yarns.

6. The papermaking fabric of claim 5 wherein each said interweave between said machine direction yarn and said extra support cross direction yarns occurs only between said adjacent interweaves of said machine direction yarns and said second set of main cross direction yarns in which there is no interweave of said machine direction yarns with any yarn of said first set of main cross direction yarns interposed therebetween.

7. The papermaking fabric of claim 6 wherein at least one yarn of said second set of main cross direction yarns is interposed between each said interweave of any said machine direction yarn with any said extra support cross direction yarn and any interweave of said machine direction yarn and any said yarn of said second set of main cross direction yarns.

8. The papermaking fabric of claim 5 wherein each said interweave of any said machine direction yarn with any said extra support cross direction yarn is spaced from any interweave of that said machine direction yarn and any yarn of said first set of main cross direction yarn by at least three of said main cross direction yarns.

9. The papermaking fabric of claim 1 further comprising a seven harness weave.

10. The papermaking fabric of claim 1 further comprising an eight harness weave.

* * * * *